United States Patent [19]

Blondelot et al.

[11] 4,175,985

[45] Nov. 27, 1979

[54] METHOD OF PRODUCING STEEL SECTIONS OF IMPROVED QUALITY

[75] Inventors: Emile Blondelot, Esch-sur-Alzette, Luxembourg; Marios Economopoulos, Liege; Stephan H. Wilmotte, Chaudfontaine, both of Belgium

[73] Assignees: Centre de Recherches Metallurgiques-Centrum voor Research in de Metallurgie, Belgium; ARBED Acieries Reunies de Burbach-Eich-Dudelange S.A., Luxembourg

[21] Appl. No.: 904,901

[22] Filed: May 11, 1978

[30] Foreign Application Priority Data

May 13, 1977 [BE] Belgium ..... 854647

[51] Int. Cl.[2] ..... C21D 1/18; C21D 1/20

[52] U.S. Cl. ..... 148/12.4; 148/12 B

[58] Field of Search ..... 148/12.4, 12 B, 12 R

[56] References Cited

U.S. PATENT DOCUMENTS

| | | | |
|---|---|---|---|
| 3,666,572 | 5/1972 | Nakagawa et al. | 148/12 B |
| 3,926,689 | 12/1975 | Respen et al. | 148/12.4 |
| 4,016,009 | 4/1977 | Economopoulos et al. | 148/12 B |
| 4,060,428 | 11/1977 | Wilson et al. | 148/12 B |

*Primary Examiner*—W. Stallard

*Attorney, Agent, or Firm*—Holman and Stern

[57] ABSTRACT

A steel section 6 to 40 mm thick, emerging from a hot rolling mill at 1000° to 800° C. is surface quenched for 2 to 6 seconds at a cooling rate of the order of 1.5 to 5 $MW/m^2$. During subsequent self-tempering of the quenched surface by heat from the remainder, the section tends to an equalization temperature of 500° to 700° C.

6 Claims, No Drawings

METHOD OF PRODUCING STEEL SECTIONS OF IMPROVED QUALITY

The present invention relates to a method of improving the quality of rolled steel products in the form of sections, the method being applicable to any kind of steel, whether killed, semi-killed, or rimming steel.

The main qualities required by users of steel sections are, among other things, as high as possible an elastic limit for the grade of steel used, as well as weldability, fatigue strength, and ductility satisfactory for the use to which the sections are to be put.

On the other hand, in order to improve weldability and ductility of a steel, it is necessary to decrease its carbon and manganese content, which concurrently results in a decrease of its tensile strength. To remedy this drawback, steel can be subjected to a suitable cooling treatment, preferably applied directly at the outlet of a rolling mill, which permits the elastic limit of the section to be raised.

When cooling is effected by convection or radiation, the cooling law of a rolled section depends to a large extent on its dimensions. Thus for a section having predetermined dimensions it is necessary, in order to modify its elastic limit, to adopt further procedures to complete the effect of the cooling as such. Among these procedures one should mention in particular increasing the content of alloying elements. This is certainly effective but has the drawback of being more costly the higher the elastic limit desired.

What is required is a method permitting the above-mentioned drawback to be eliminated without increasing the carbon and manganese content of the steel in a way which is inacceptable with regard to weldability.

The present invention provides a method in which, at the outlet of a hot rolling mill, the said section while being at a temperature of 1000° to 800° C. is subjected to surface quenching for 2 to 6 seconds, the section whose thickness is of 6 to 40 mm being subjected during quenching to a cooling rate of the order of 1.5 to 5 $MW/m^2$, the equalization temperature of the section due to self-tempering being between 500° and 700° C. Self-tempering is tempering of the quenched surface by heat conducted to that surface from the remainder of the section. The equalization temperature is the temperature towards which the quenched surface and the remainder of the section converge during self-tempering.

The application of this method to steel containing 0.11 to 0.20% carbon, 0.5 to 1.1% manganese, 0.20 to 0.40% silicon, and 0.018 to 0.040% aluminium made it possible to classify this steel as St.52 with an elastic limit higher than 36 kg/mm2 and a Charpy V impact strength higher than 5 kg/cm2 at −20° C. The same method when applied to steel containing 0.11 to 0.20% carbon and 0.5 to 1.1% manganese but being of a semi-killed kind made it possible to obtain steel of the same class but whose Charpy V impact strength was higher than 3 kg/cm2 at −20° C.

In a second test of the method according to the invention, applied this time to steel containing 0.05 to 0.20% carbon, 0.20 to 0.40% silicon, 1 to 2% manganese, and 0.018 to 0.040% aluminium, the steel being aluminium killed and optionally also containing 0.015 to 0.040% niobium, it was possible to obtain steel of class St.E47 whose elastic limit was at least 47 $kg/mm^2$ and whose Charpy V impact strength was 5 $kg/cm^2$ at −20° C.

In a third test of the method according to the invention, applied to steel having the same composition as the preceding steel but containing up to 0.06% niobium and 0.04 to 0.20% vanadium, it was possible to obtain steel of class St.E70 with an elastic limit of at least 70 $kg/mm^2$ and a Charpy V impact strength higher than 5 $kg/cm^2$ at −60° C.

We claim:

1. A method of improving the quality of a steel section having a thickness of 6 to 40 mm, emerging from a hot rolling mill at a temperature of 1000° to 800° C., the method comprising subjecting the section to surface quenching for 2 to 6 seconds, wherein the cooling rate during the surface quenching is of the order of 1.5 to 5 $MW/m^2$, and the equalization temperature of the section due to subsequent self-tempering is 500° to 700° C.

2. A method as claimed in claim 1, in which the steel contains 0.11 to 0.20% carbon, 0.5 to 1.1% manganese, 0.20 to 0.40% silicon, and 0.018 to 0.040% aluminium.

3. A method as claimed in claim 1 or 2, in which the steel is semi-killed steel containing 0.11 to 0.20% carbon, 0.5 to 1.1% manganese, 0.20 to 0.40% silicon, and 0.018 to 0.040% aluminium.

4. A method as claimed in claim 1, in which the steel is aluminium killed steel containing 0.05 to 0.20% carbon, 0.20 to 0.40% silicon, 1 to 2% manganese, and 0.018 to 0.040% aluminium.

5. A method as claimed in claim 4, in which the steel further contains 0.015 to 0.040% niobium.

6. A method as claimed in claim 1, in which the steel contains 0.05 to 0.20% carbon, 0.20 to 0.40% silicon, 1 to 2% manganese, 0.018 to 0.040% aluminium, max. 0.06% niobium, and 0.04 to 0.20% vanadium.

* * * * *